US012313298B2

(12) United States Patent
Deivasigamani et al.

(10) Patent No.: US 12,313,298 B2
(45) Date of Patent: May 27, 2025

(54) FAILURE MODE DETERMINATION MEANS

(71) Applicant: Intellihot, Inc., Galesburg, IL (US)

(72) Inventors: Sridhar Deivasigamani, Mundelein, IL (US); Sivaprasad Akasam, Round Rock, TX (US)

(73) Assignee: Intellihot, Inc., Galesburg, IL (US)

( * ) Notice: Subject to any disclaimer, the term of this patent is extended or adjusted under 35 U.S.C. 154(b) by 173 days.

(21) Appl. No.: 18/211,154

(22) Filed: Jun. 16, 2023

(65) Prior Publication Data

US 2024/0418409 A1 Dec. 19, 2024

(51) Int. Cl.
*F24H 15/104* (2022.01)
*F24H 1/20* (2022.01)
*F24H 15/223* (2022.01)

(52) U.S. Cl.
CPC ..... *F24H 15/104* (2022.01); *F24H 1/201* (2013.01); *F24H 15/223* (2022.01)

(58) Field of Classification Search
CPC ..... F24H 15/104; F24H 15/246
See application file for complete search history.

(56) References Cited

U.S. PATENT DOCUMENTS 5,442,157 A * 8/1995 Jackson ..... F24H 15/395 219/508
2006/0013573 A1* 1/2006 Phillips ..... F24H 9/2021 392/459
2007/0108187 A1* 5/2007 Ding ..... F24H 15/407 219/492
2007/0210067 A1* 9/2007 Patterson ..... F24H 9/2014 219/481

FOREIGN PATENT DOCUMENTS

CA 2954619 C * 10/2018 ..... F24H 1/202

* cited by examiner

*Primary Examiner* — Steven S Anderson, II
(74) *Attorney, Agent, or Firm* — Jong Patent Firm; Cheng Ning Jong; Tracy P. Jong

(57) ABSTRACT

A method for determining a false reporting of a liquid level detection in a system including a container configured to hold a liquid to a first liquid level in the container, a heater disposed within the container, the heater configured to heat at least a portion of the liquid, a temperature sensor disposed above the heater within the container, the temperature sensor configured to sense the temperature of its surroundings, the method including effecting the heater for a duration; determining the rate at which the temperature rises; and comparing the temperature rise rate to a liquid temperature rise rate threshold, wherein if the temperature rise rate is greater than the liquid temperature rise rate threshold, the temperature sensor is determined to not have been submerged in the liquid and a reporting of the liquid level detection in the system is deemed false.

4 Claims, 10 Drawing Sheets

FAILURE MODE DETERMINATION MEANS

BACKGROUND OF THE INVENTION

1. The Field of the Invention

The present invention relates to various means for determining the health of water heater and thermal battery components. More specifically, the present invention is directed to various means for determining the health of water heater and thermal battery components which remove the need for verifying the proper functioning of individual components at the component level.

2. Background Art

Traditional failure mode detections means require dedicated monitoring of specific components of equipment for accurate detection of failure modes. For instance, in order to identify a failure mode associated with the process of water heating of a water heater or the equipment associated with heating of a water heater or the equipment with associated with storing heat harnessed using the water heater, various components of the water heater and/or thermal storage system/thermal battery must be monitored as the failure of any one of the components may contribute to the failure in water heating, causing prolonged shutdowns of these systems. Typical components found in an electric water or fluid heating system include one or more blowers, compressors, pumps, heat exchangers, various flow valves, resistive heating elements and temperature sensors, etc. The failure of just one of these components can cause the water heater to fail. For instance, if the pump of a thermal charging circuit of a thermal battery is not operable, no heating can occur or no storing of thermal energy can occur in the thermal battery as the pump is configured to move heated fluids in the charging circuit to be disposed in the thermal battery. If a resistive heating element configured to provide supplemental heating is dysfunctional, the supply of heated water will be delayed when a hot water demand can only be met by also using the resistive heating element. Therefore, in order to accurately identify a failure mode in a conventional electric water heating system, various components must be monitored. For instance, in order to monitor the level of the contents in a thermal battery, a level sensor and the proper functioning of the level sensor must be monitored to ensure that the level sensor reports true levels of the contents of the thermal battery. It is possible to provide more than one level sensor such that the level of the contents as reported by one level sensor can be verified against values reported by a second level sensor. However, if multiple sensors are required for performing a function in the system, a tremendous cost will be incurred on heating and thermal storage systems. Further, in a thermal charging circuit which includes a pump and a heat exchanger connected in series, the root cause for a failure to provide heating may not lie in the pump as a blocked heat exchanger will also prevent external heat to be transferred to the charging circuit which returns thermal energy with a heated flow to be stored in the thermal battery. Therefore, if a blocked heat exchanger which causes no flow, is the root cause, the lack of flow in a charging circuit may have falsely indicated that the pump is dysfunctional. Therefore, it is not difficult to realize that by adding a simple monitoring system for each component or the doubling of the equipment in a heating and thermal storage system can quickly become costly and difficult to implement as the points of failure are numerous and the labor and materials associated with the system can be cost prohibitive to procure and maintain. Further, it would have been difficult to monitor equipment of different makes by a single party as there is a lack standards for monitoring equipment and reporting or communication devices to communicate sensor data that can be readily understood and utilized. Further, if equipment health is monitored and reported by original equipment manufacturers (OEM), monitoring of equipment at a locale or mechanical room may only be performed in a disparate manner requiring input from various OEMs.

There arises a need for a system capable of determining failure modes without incurring large costs associated with the procurement and operation of additional and dedicated monitoring components.

SUMMARY OF THE INVENTION

In accordance with the present invention, there is provided a method for determining a false reporting of a suitable liquid level detection in a system including a container configured to hold a liquid to a first liquid level in the container, a heater disposed within the container, the heater configured to heat at least a portion of the liquid, a temperature sensor disposed above the heater within the container, the temperature sensor configured to sense the temperature of its surroundings, the method including:

(a) effecting the heater for a duration;

(b) determining the rate at which the temperature rises; and (c) comparing the temperature rise rate to a liquid temperature rise rate threshold, wherein if the temperature rise rate is greater than the liquid temperature rise rate threshold, the temperature sensor is determined to not have been submerged in the liquid and the false reporting of a suitable liquid level detection in the system is deemed to have occurred.

In one embodiment, the duration is more than about 10 seconds. In one embodiment, the liquid temperature rise rate threshold is about 10 degrees F./minute. In one embodiment, the heater is a resistive heater.

In accordance with the present invention, there is further provided a method for determining a faulty heat source of a thermal battery, the thermal battery is filled with a working fluid configured to be heated by the heat source disposed within the thermal battery, the thermal battery further having a temperature sensor disposed above the heat source, the temperature sensor configured to sense the temperature of its surroundings, the method including:

(a) obtaining a first reading of the temperature sensor and effecting the heat source for a duration; and (b) obtaining a second reading of the temperature sensor and comparing the second reading to the first reading, wherein if the second reading is not greater than the first reading by a threshold, the heat source is said to be faulty.

In one embodiment, the duration is about 30 seconds. In one embodiment, the threshold is about 2 degrees F. In one embodiment, the heat source is a resistive heater.

In accordance with the present invention, there is further provided a method for determining the proper functioning of an isolation valve of a discharging circuit of a thermal battery, the isolation valve disposed on an inlet of the discharging circuit, the method including:

(a) controlling the isolation valve to an open position;

(b) effecting a demand through the discharging circuit; and (c) determining the existence of a flow through the discharging circuit, wherein if the flow does not exist, the isolation valve is said to be dysfunctional.

In accordance with the present invention, there is further provided a method for determining the proper functioning of an isolation valve of a discharging circuit of a thermal battery, the isolation valve disposed on an inlet of the discharging circuit, the method including:

(a) controlling the isolation valve to a closed position;

(b) effecting a demand through the discharging circuit; and (c) determining the existence of a flow through the discharging circuit, wherein if the flow does exist, the isolation valve is said to be dysfunctional.

In accordance with the present invention, there is further provided a method for determining the proper functioning of a fill valve configured to enable a flow of a solvent into a thermal battery, the fill level of the thermal battery is configured to be determined using a level sensor, the method including:

(a) controlling the fill valve to an open position;

(b) effecting a flow of the solvent through the fill valve for a duration; and (c) determining a fill level of the thermal battery, wherein if the thermal battery is determined by the level sensor to not have been filled, at least one of the fill valve and the level sensor is determined to be dysfunctional.

In one embodiment, the duration is about 1 hour.

In accordance with the present invention, there is further provided a method for controlling the discharging of a thermal battery including a container for holding a heat storage medium and a coil including an inlet and an outlet, the coil configured for causing an inlet flow received at the inlet to be an outlet flow disposed at a resultant temperature at the outlet, a first control valve interposed at the inlet for controlling the inlet flow into the coil, a second control valve interposed at the outlet for controlling a bypass flow of the inlet flow that merges with the outlet flow, the method including comparing the resultant temperature to a desired temperature, wherein if the resultant temperature is lower than the desired temperature, the first control valve is closed.

In accordance with the present invention, there is further provided a method for determining the proper functioning of a heat source of a thermal battery including a heat storage medium, the heat source including a pump and a heat exchanger interposed in a circulation loop of the thermal battery, the method including:

(a) effecting a circulation of the heat storage medium through the circulation loop by turning on the pump for a duration; and (b) determining a first temperature of the heat storage medium at an inlet of the circulation loop and a second temperature of the heat storage medium at an outlet of the circulation loop, wherein if the first temperature is substantially the same as the second temperature, at least one of the pump and heat exchanger is said to be dysfunctional.

In one embodiment, the duration is about 20-30 seconds.

In accordance with the present invention, there is further provided a method for mitigating risks associated with inadvertent freezing of an evaporator of a heat pump system comprising an evaporator fluidly connected to an expansion valve disposed upstream of the evaporator of a refrigerant flow and a temperature sensor configured to sense a temperature of the evaporator, the method including comparing the temperature of the evaporator to a threshold, wherein if the temperature of the evaporator is lower than the threshold, opening the expansion valve further to cause the refrigerant flow to receive additional heat to mitigate risks associated with freezing of the evaporator.

In one embodiment, the threshold is about 35 degrees F.

An object of the present invention is to provide a method for determining a false reporting of a liquid level detection in a system.

Another object of the present invention is to provide a method for determining a faulty heat source of a thermal battery.

Another object of the present invention is to provide a method for determining the proper functioning of an isolation valve of a thermal battery.

Another object of the present invention is to provide a method for determining the proper functioning of a fill valve configured to enable a flow of a solvent into a thermal battery.

Another object of the present invention is to provide a method for determining the proper functioning of a heat source of a thermal battery.

Another object of the present invention is to provide a method for controlling the discharging of a thermal battery.

Another object of the present invention is to provide a method for determining the proper functioning of a heat source of a thermal battery.

Another object of the present invention is to provide a method for mitigating risks associated with inadvertent freezing of an evaporator of a heat pump system.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
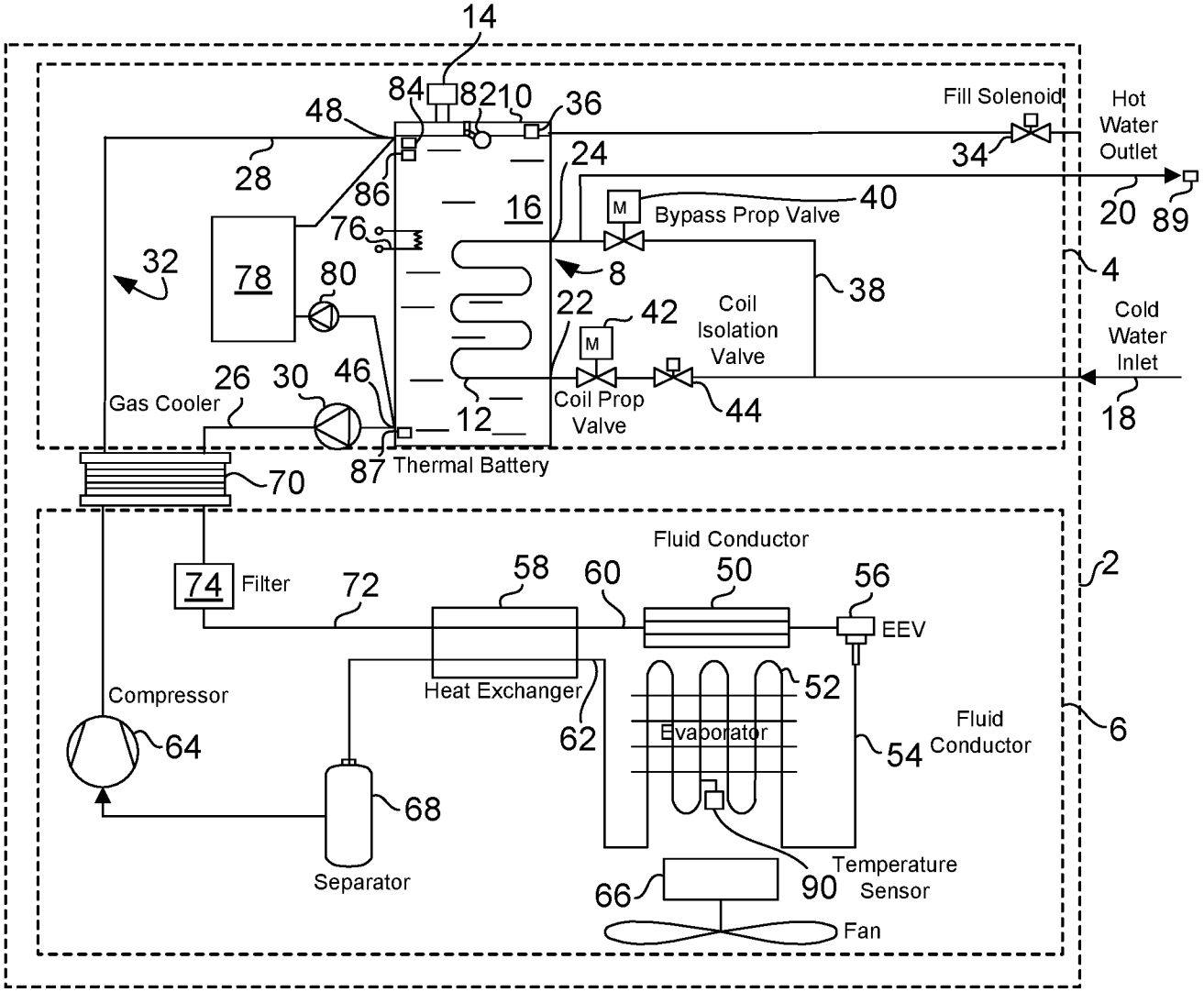
FIG. 1 is a diagram depicting a heating system including a thermal battery.

2—heating system
4—subsystem
6—subsystem
8—thermal battery
10—storage container
12—fluid conductor or coil
14—opening
16—first fluid or thermal storage medium
18—water inlet
20—water outlet
22—inlet point
24—outlet point
26—outlet fluid conductor
28—inlet fluid conductor
30—pump
32—heat supply loop or circulation loop or charging circuit
34—fill valve or fill solenoid
36—level sensor
38—bypass conductor
40—bypass valve
42—inlet valve
44—coil isolation valve
46—inlet to storage container
48—outlet from storage container
50—fluid conductor
52—evaporator
54—fluid conductor
56—expansion valve
58—heat exchanger
60—upstream fluid conductor
62—downstream fluid conductor
64—compressor
66—blower
68—separator
70—heat exchanger, e.g., gas cooler
72—fluid conductor
74—filter
76—resistive heater
78—solar heater
80—pump
82—float switch
84—glycol concentration sensor
85—thermal output of resistive heater
86—temperature sensor
87—temperature sensor
88—controller
89—temperature sensor
90—temperature sensor
92—step of effecting heater for a duration
94—step of determining rate at which temperature rises
96—step of comparing temperature rise rate to liquid temperature rise rate threshold
98—step of showing determination of reporting of liquid level detection had been false
100—step of obtaining first reading of temperature sensor and effecting heat source for a duration
102—step of obtaining second reading of temperature sensor and comparing second reading to first reading
104—step of determining second reading to not be greater than first reading by a threshold
106—step of showing heat source is faulty
108—step of controlling isolation valve to open position
110—step of effecting demand through discharging circuit
112—step of determining the existence of flow through isolation valve
114—step of showing isolation valve is dysfunctional
116—step of controlling isolation valve to closed position
118—step of controlling fill valve to open position
120—step of effecting flow of the solvent through fill valve for a duration
122—step of determining whether fill level of thermal battery is appropriate
124—step of showing fill valve and/or level sensor is dysfunctional
126—step of comparing resultant temperature with desired temperature
128—step of determining whether resultant temperature is lower than the desired temperature
130—step of controlling first control valve and second control valve to closed position
132—step of effecting a circulation of heat storage medium through circulation loop for a duration
134—step of determining first temperature of the heat storage medium at inlet of circulation loop and second temperature of the heat storage medium at outlet of circulation loop
136—step of determining first temperature is substantially the same as second temperature
138—step of comparing evaporator temperature to threshold
140—step of determining whether evaporator temperature is too low
142—step of opening expansion valve Particular Advantages of the Invention The present means for determining the health of water heater and thermal battery components which remove the need for verifying the proper functioning of individual components at the component level. For components having functionality that may not be verified at the component level, the present methods provide means for inferring the proper functioning and therefore the health of those components. In some instances, functional redundancy can be provided to identify problems that may not be uncovered at the component level, e.g., a dysfunctional resistive heater and isolation valve, etc., or to determine with higher certainty the root cause of problems.

DETAILED DESCRIPTION OF A PREFERRED EMBODIMENT

The term "about" is used herein to mean approximately, roughly, around, or in the region of. When the term "about"

is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIG. 1 is a diagram depicting a heating system including a thermal battery. The heating system 2 includes essentially two subsystems, i.e., subsystem 4 which holds an interface between a heat source and a heat sink and subsystem 6 which serves as a heat source. In the embodiment shown, the heat source is an improved heat pump. Each subsystem may herein be individually referred to as a heating system as it either receives heating from another system or subsystem, as in subsystem 4 or it is responsible for supplying thermal energy to another system or subsystem, as in subsystem 6. Regarding subsystem 4, the heating system includes a thermal battery 8 which includes a storage container 10 and a fluid conductor 12 disposed through the storage container 10. The storage container 10 includes an opening 14 and is configured to hold a first fluid therein. The opening 14 is configured to expose the first fluid 16 to atmospheric pressure. As such, the storage container 10 is not a pressurized vessel and not required to withstand pressure exerted by pressurized contents and therefore can be made to meet minimal requirements of a storage container, resulting in an inexpensive, easy-to-fabricate and maintain storage container. Contrast this to conventional thermal batteries where pressurized tanks are used. The container 10 needs not be built to withstand a pressure higher than the ambient pressure and therefore no special materials and container wall thicknesses that are required to provide a container capable of withstanding pressure significantly higher than the ambient pressure. Such a container is therefore ubiquitous, has low procurement and maintenance costs. Referring to subsystem 4, it shall be noted that cold water is received at a cold water inlet 18 with an inlet pipe which connects the cold water inlet 18 to the fluid conductor 12. Heated water is supplied at a hot water outlet 20 via an outlet pipe which connects the fluid conductor 12 to the hot water outlet 20. Temperature sensor 89 is configured to provide the effluent temperature of the coil 12. The fluid conductor 12 is disposed through the first fluid 16, e.g., glycol, from an inlet point 22 at the storage container 10 to an outlet point 24 at the storage container 10, the fluid conductor 12 is configured to receive a second fluid at a first temperature at the inlet point and to supply the second fluid, e.g., potable water, at a second temperature higher than the first temperature.

In the embodiment shown, subsystem 4 further includes a heat source configured to supply the first fluid 16 with thermal energy via the working fluid exiting the storage container 10 through the outlet fluid conductor 26 and returning to the storage container through the inlet fluid conductor 28. Here, thermal energy is received via a flow motivated by pump 30 through heat exchanger 70. Due to the location of the pump 30 relative to the first fluid 52 in the storage container, it is self-priming. No manual priming is required prior to its use as long as the thermal battery 16 has been properly set up. In one embodiment, the pump 30 is a variable speed pump to allow the system to modulate the flowrate through the heat supply loop 32, thereby affecting the thermal charging rate of the thermal battery 8. For instance, the thermal charging rate of the thermal battery 16 may be correlated to the rate at which thermal energy may be transferred from subsystem 6 to avoid unnecessary circulation of the first fluid 16. The first fluid 16 held in the storage container is stratified, i.e., the temperature of the first fluid near the top of the storage container is disposed at a temperature higher than the first fluid near the bottom of the storage container. Therefore, the inlet point 22 is disposed in the first fluid 16 at a first temperature and the outlet point is disposed in the first fluid 16 at a second temperature where the second temperature is higher than the first temperature. As the first temperature is lower and the thermal energy of the contents in the lower region of the storage container has been largely depleted, this ensures that the first fluid drawn by the pump 30 is devoid of thermal energy and ready to draw thermal energy from heating system 6. In one embodiment, the first fluid 16 is a glycol-water mixture or it is simply referred to as "glycol."

Subsystem 4 further includes a fill valve 34 configured to control the filling of the storage container 10. A glycol solution can be formed by adding water via fill valve 34 to glycol already disposed in the storage container 10. A glycol concentration sensor 84 is further provided to determine whether the concentration of glycol is suitable for the locale the heating system is used in. In the embodiment shown, a fluid level sensor 36 is provided to allow the level of the storage container contents to be determined. This allows the exact level of the contents to be determined and the amount of glycol to be replenished. The present heating system is shipped to site with the storage container 10 void of fluid to avoid unnecessary shipment of weighted storage container and the storage container 10 is filled on site to make transportation of the heating system more cost effective and the heating system easier to set up. Subsystem 4 further includes a bypass conductor 38 connecting an inlet and an outlet of the fluid conductor 12. A valve 40 is interposed in the bypass conductor 38 to control the magnitude of a bypass flow that is allowed to occur through the bypass conductor 38. An inlet valve 8 is disposed at the inlet of the fluid conductor 12 to control the magnitude of a flow through the fluid conductor 12. A coil isolation valve 44 is connected to the inlet point 22, wherein the coil isolation valve is configured for selectively allowing a flow of the second fluid. The coil isolation valve 44 serves as a fail-safe mechanism for an inlet valve 42 which fails as the coil isolation valve 44 is a spring-returned valve configured to close automatically should the inlet valve 42, e.g., a proportional valve fails. This way, a failed inlet valve 42 would not inadvertently cause a flow to be heated indefinitely in the thermal battery 8 to cause a scalding hot output at the outlet 20. Once the coil isolation valve 44 is closed, an incoming flow through the cold water inlet 18 will be diverted to the bypass conductor 38. A user of the demand will experience unheated water but will avoid potentially scalding hot water due to the failed inlet valve 42. A pump 30 interposed in a heat supply loop 32 connected to the storage container 10 at an outlet 46 and at an inlet 48, controls the magnitude of circulation of the contents of the storage container 10 and hence controls the rate at which heat energy is supplied to the contents 16 of the storage container 10. A temperature sensor 86 is disposed at the inlet 48 to indicate the temperature of the first fluid 16 entering the thermal storage container 10 when a circulation is available in the heat supply loop 32. When a circulation is absent, the same temperature sensor 86 may be used to indicate a representative temperature of an upper portion of the first fluid 16.

Regarding subsystem 6, the heating system includes a first fluid conductor 50, an evaporator 52, a second fluid conductor 54 and an expansion valve 56. The evaporator 52 is thermally connected to the first fluid conductor 50 by a mode of convection. A temperature sensor 90 is configured to detect the refrigerant temperature through the evaporator 52.

The second fluid conductor 54 connects the first fluid conductor 50 to the evaporator 52. The expansion valve 56 is interposed in the second fluid conductor 54. A working fluid received at the first fluid conductor 50 is configured to be supplied to the evaporator 52 through the second fluid conductor 54 and the expansion valve 56. Heat loss from the working fluid in the first fluid conductor 50 is at least compensated by a heat gain by the evaporator 52 due to the working fluid in the first fluid conductor 50 disposed at a lower temperature caused by the heat loss. Subsystem 6 further includes a heat exchanger 58 including an upstream fluid conductor 60 and a downstream fluid conductor 62 thermally coupled to the upstream fluid conductor 58. The upstream fluid conductor 58 is configured to be connected to an inlet port of the first fluid conductor 50 and the downstream fluid conductor 62 is configured to be connected to an outlet port of the evaporator 52 and heat transfer is configured to occur from the working fluid in the upstream fluid conductor 60 to the working fluid in the downstream fluid conductor 60.

The first fluid conductor 50 includes a featureless outer surface. Applicant discovered that by lowering the temperature of the working fluid going into the expansion valve 56 due to heat loss from the working fluid via the first fluid conductor 50, the heat gained by the working fluid in the evaporator 52 by convection between the first fluid conductor 50 and the evaporator 52 and the evaporator 52 and its surroundings, exceeds the alternative, thereby improving Coefficient of Performance (COP) of the heat pump 6. COP is defined as the relationship between the power that is drawn out of a heat pump as cooling or heat, and the power that is supplied to the compressor, e.g., compressor 64 of the heat pump. However, Applicant also discovered that if the outer surface of the first fluid conductor 50 had been equipped with heat transfer fins, rather than being featureless, heat loss from the working fluid through the first fluid conductor 50 or the temperature drop in the working fluid via convection would have been too severe for the evaporator 52 to regain heat, resulting in a net thermal energy loss instead of a net thermal energy gain as in the case of the featureless first fluid conductor 50. In one embodiment, the working fluid is a refrigerant. The mode of convection is configured to be aided by a blower 66. The upstream fluid conductor 60 and the downstream fluid conductor 62 are fluidly connected via fluid conductor 40. Upon leaving downstream fluid conductor 62, the working fluid flows through a separator 68, where the separator is disposed downstream from the downstream fluid conductor 62. Upon leaving the separator 68, the working fluid flows through a compressor 64 disposed downstream from the separator 68. Upon leaving compressor 64, the working fluid flows through a heat exchanger 70, e.g., a gas cooler, disposed downstream from the compressor 64. The heat exchanger 70 thermally connects fluid conductor 72 of subsystem 6 with heat supply loop 32 of subsystem 4. Upon leaving heat exchanger 70, the working fluid flows through a filter 74. In heat exchanger 70, e.g., a gas cooler, thermal energy is transferred from the working fluid in fluid conductor 72 to the working fluid of the heat supply loop 32. It shall be noted that the heat energy supplied to the first fluid 16 originates from subsystem 6. Although subsystem 6 is shown as a heat pump, the first fluid 16 may instead receive its heat energy from another source, e.g., a solar heater and a resistive heater 76, etc., provided that the heat supply loop 32 remains fluidly isolated from the fluid flow of fluid conductor 12. In one embodiment, the heating system 2 further includes a solar heater 78 connected to the storage container 10 via the outlet fluid conductor and the inlet fluid conductor of the storage container 10. Therefore, in addition to subsystem 6, the thermal battery 8 may additionally or alternatively receive thermal energy from the solar heater 78. A pump 80 is provided to allow circulation of the working fluid through the solar heater 78 to add thermal energy to the contents of the storage container 10. Again, the flow exiting the storage container 10 at the outlet fluid conductor is preferably disposed at the lowest temperature possible due to stratification of the contents of the storage container 10 to maximize heat transfer to the working fluid at the solar heater 78. The level of the contents of the storage container can also be ascertained using the float switch 82 as the right content level causes the float switch 82 to report a state indicating that the contents are disposed at an appropriate level.

Figure 2:
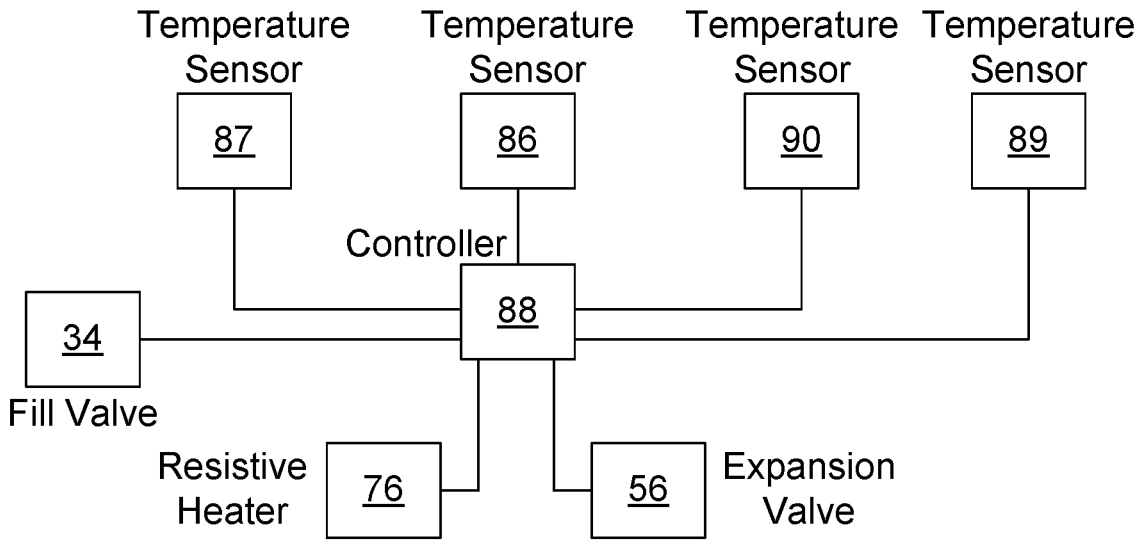
FIG. 2 is a diagram depicting a controller functionally connected to a plurality of devices or components shown in FIG. 1.

FIG. 2 is a diagram depicting a controller functionally connected to a plurality of devices or components shown in FIG. 1. Temperature sensor 86, temperature sensor 87, temperature sensor 89, temperature sensor 90, pump 80, resistive heater 76, isolation valve 44, fill valve 34, and expansion valve 56 are each functionally connected to a controller 88. The heating system of FIG. 1 operates under the control of control circuitry or controller 88. This circuitry will typically include one or more processors with supporting memory circuitry and/or firmware that stores routines carried out by the processor, as described below. The processor may be of any suitable type, including microprocessors, field programmable gate arrays, processors of special purpose and general purpose computers, and so forth. Similarly, memory might include random access memory, flash memory, read only memory, or any other suitable type. Although not separately represented, the circuitry will also include or be associated with input/output circuitry for receiving sensed signals, and interface circuitry for outputting control signals for the valving, motors, and so forth.

Figure 3:
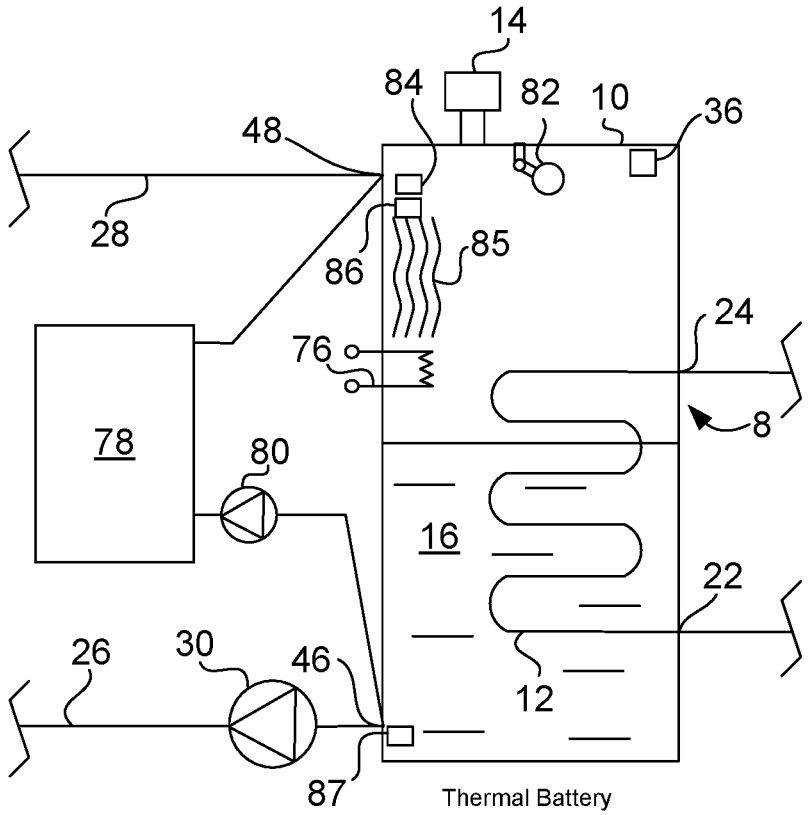
FIG. 3 is a diagram depicting a partial close-up view of the thermal battery of FIG. 1 where there is insufficient thermal storage medium in the thermal battery.
Figure 3A:
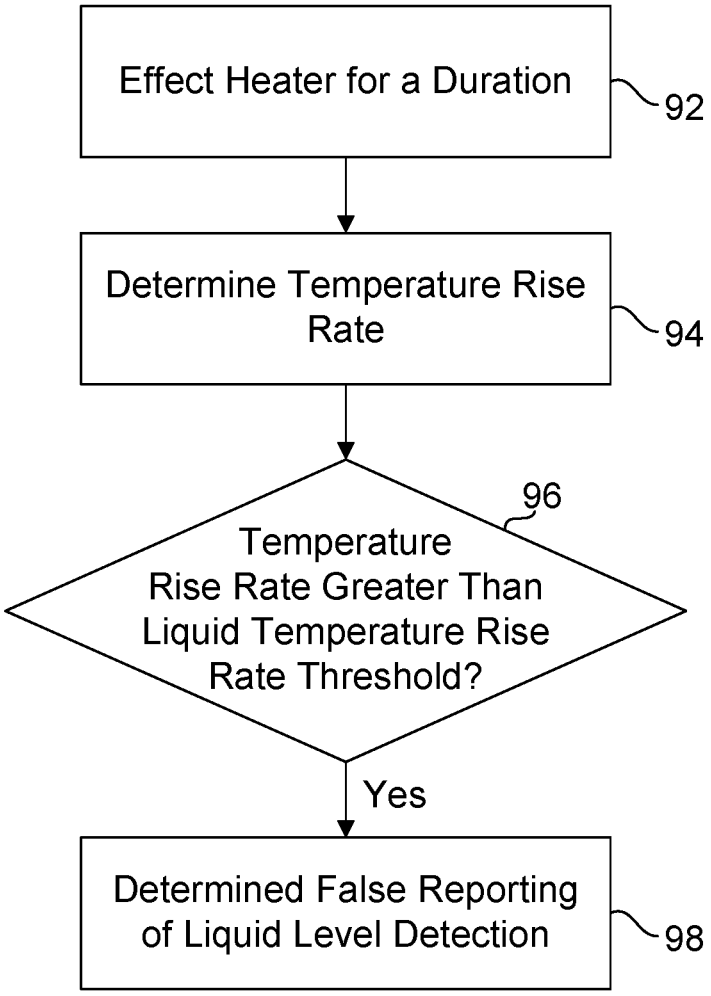
FIG. 3A is a diagram depicting a manner in which a false reporting of the liquid level of the thermal battery of FIG. 1 is determined.

FIG. 3 is a diagram depicting a partial close-up view of the thermal battery of FIG. 1 where there is insufficient thermal transfer medium 16 in the thermal battery. In this scenario, the liquid level is reported, e.g., by the level sensor 36 as being disposed at a suitable level, a level above the inlet of the charging circuit 32 into the thermal battery. However, in reality, the level of the thermal transfer medium 16 is well below the resistive heater 76, exposing the temperature sensor 86 directly, e.g., about 3-12 inches, above the resistive heater 76. Therefore, if the resistive heater 76 is turned on, thermal energy will rise to influence the temperature sensor 86 directly, causing a rapid temperature rise as it does not need to heat up a volume of thermal transfer medium 16 having a much higher specific heat than a volume of air. FIG. 3A is a diagram depicting a manner in which a false reporting of a suitable liquid level of the thermal battery of FIG. 1 is determined. Disclosed herein is a method useful for determining a false reporting of a suitable liquid level detection in a system. Referring back to FIGS. 1 and 2, the system includes a container configured to hold a liquid 16 to a first liquid level in the container, a heater disposed within the container, the heater configured to heat at least a portion of the liquid 16, temperature sensor 86 is disposed above the heater, e.g., the resistive heater 76, preferably in the vicinity where the charging circuit empties into the container 10, i.e., at the outlet of the heat supply loop 32. Temperature sensor 86 is configured to sense the temperature of its surroundings. The method includes effecting the heater 76 for a duration as shown in step 92. The rate at which the temperature rises is then determined as shown in step 94. The temperature rise rate is then compared to a liquid temperature rise rate threshold as shown in step 96. If the temperature rise rate is greater than the liquid temperature rise rate threshold, the temperature sensor 86 is determined to not have been submerged in the liquid and the false reporting of a suitable liquid level detection in the system is deemed or determined to have occurred as shown in step 98. In one embodiment, the duration is more than about 10 seconds. In one embodiment, the liquid temperature rise rate threshold is about 10 degrees F./minute. In this case, although there is insufficient liquid in the thermal battery as the liquid level drops below the resistive heater 76, the liquid level is reported, e.g., by the level sensor 36 as being disposed at a suitable level. In reality, the resistive heater 76 does not come in contact with the contents 16 of the thermal battery as the temperature rise rate, as detected by temperature sensor 86 indicates that it would have been impossible for the temperature rise rate to be disposed at an overly high level if the resistive heater 76 had been submerged in the contents 16 as a large volume of a liquid surrounding the resistive heater 76 would have to be heated and the temperature rise rate as detected by temperature sensor 86 would have been much lower.

Figure 4:
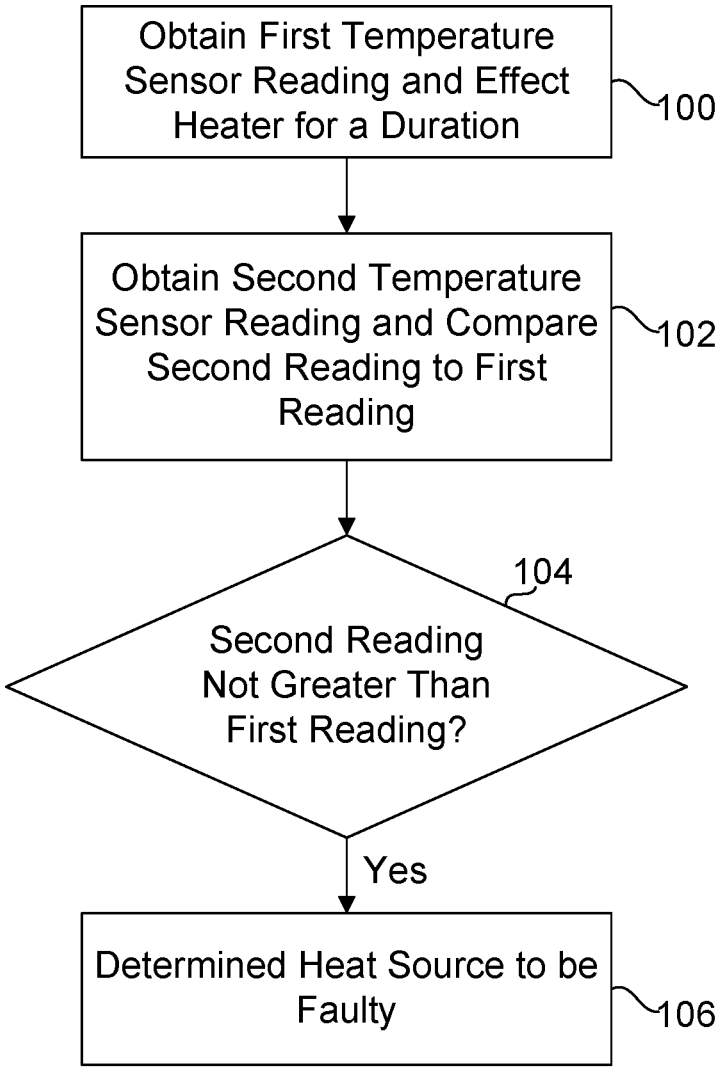
FIG. 4 is a diagram depicting a manner in which a faulty heat source of FIG. 1 is determined.

When a demand for hot water exceeds the rate at which hot water can be provided at the hot water outlet 20, the resistive heater 76 can be turned on to provide supplemental heating of the heat storage medium 16 to reduce the time it takes the heat storage medium 16 to reach a desired temperature profile and to add thermal energy to the thermal battery. Therefore, the proper functioning of the resistive heater 76 is critical in ensuring that certain larger demands of hot water in a system shown in FIG. 1 can be met by thermal energy drawn from the thermal battery as shown. FIG. 4 is a diagram depicting a manner in which a faulty heat source of FIG. 1 is determined. Disclosed herein is a method useful for determining a faulty heat source, e.g., resistive heater 76, of a thermal battery. The thermal battery is filled with a working fluid configured to be heated by the heat source disposed within the thermal battery, the thermal battery further having a temperature sensor 86 disposed above the heat source 76, the temperature sensor configured to sense the temperature of its surroundings. The method includes obtaining a first reading of the temperature sensor 86 and effecting the heat source for a duration, e.g., about 30 seconds, as shown in step 100. This is followed by obtaining a second reading of the temperature sensor 86 and comparing the second reading to the first reading as shown in step 102. If the second reading is determined to not be greater than the first reading by a threshold as shown in step 104, the heat source is said to be faulty as shown in step 106. In one embodiment, the threshold is about 2 degrees F.

Figure 5:
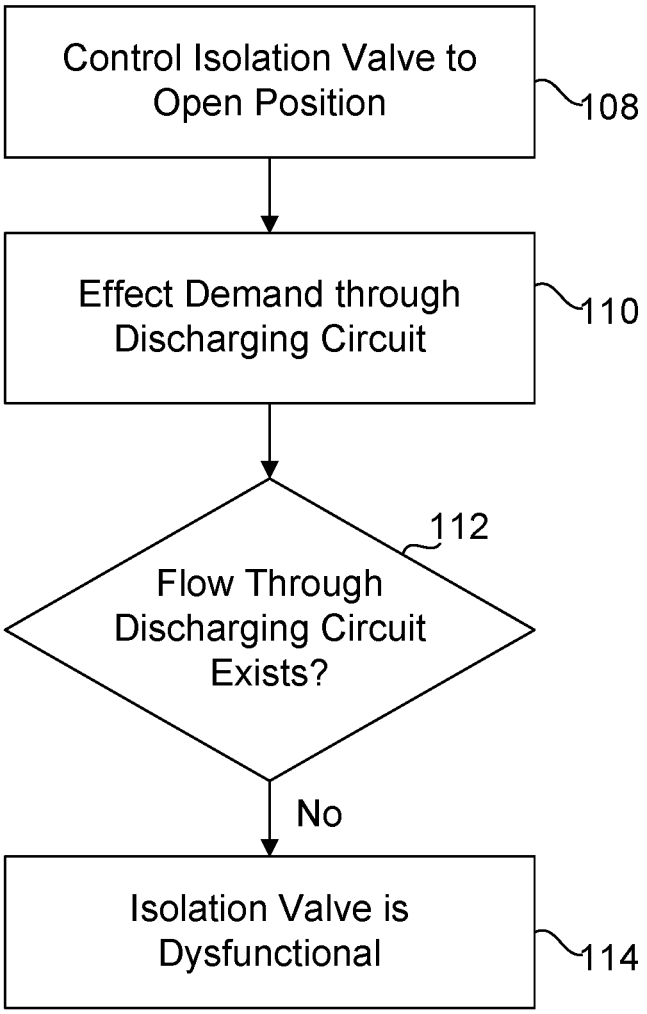
FIG. 5 is a diagram depicting a manner in which a dysfunctional isolation valve of FIG. 1 is determined.

FIG. 5 is a diagram depicting a manner in which a dysfunctional isolation valve 44 of FIG. 1 is determined. Disclosed herein is a method useful for determining the proper functioning of an isolation valve 44 of a discharging circuit of a thermal battery. The isolation valve 44 is disposed on an inlet side of the discharging circuit, e.g., coil 12. The method includes controlling the isolation valve 44 to an open position as shown in step 108. This is followed by effecting a demand through the discharging circuit as shown in step 110, e.g., by opening a valve connected to a downstream location of the water outlet 20, e.g., at a faucet. Then the existence of a flow through the isolation valve 44 is determined as shown in step 112, e.g., by detecting whether a flow exists at the valve, e.g., the faucet, connected to a downstream location of the water outlet 20. If the flow does not exist, the isolation valve 44 is said to be dysfunctional as shown in step 114.

Figure 6:
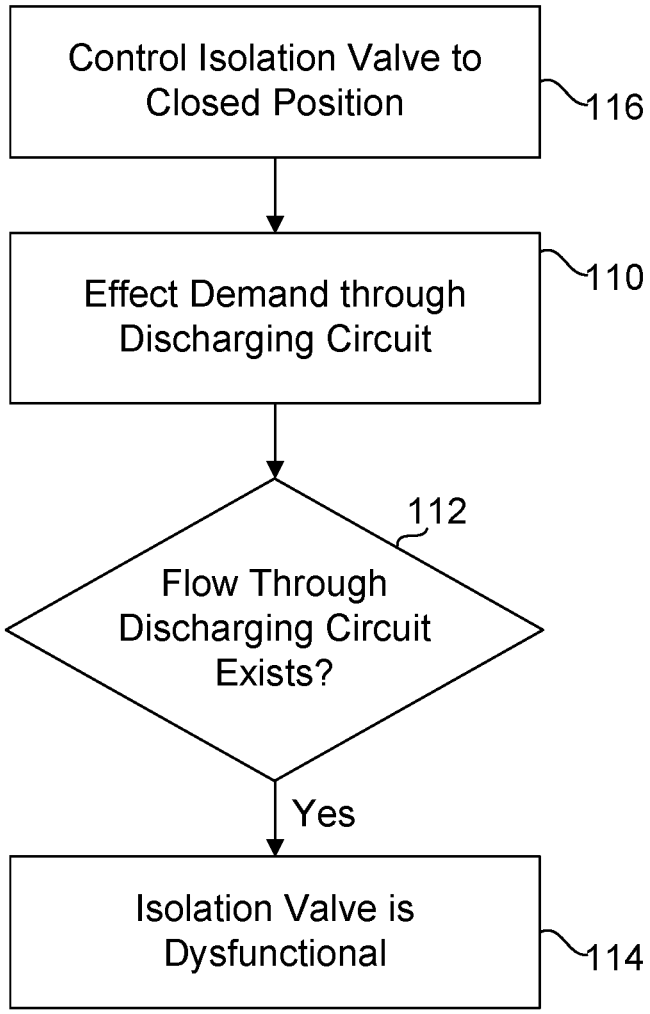
FIG. 6 is a diagram depicting a manner in which a dysfunctional isolation valve of FIG. 1 is determined.

FIG. 6 is a diagram depicting a manner in which a dysfunctional isolation valve 44 of FIG. 1 is determined. Disclosed herein is a method useful for determining the proper functioning of an isolation valve 44 of a discharging circuit of a thermal battery. The isolation valve 44 is disposed on an inlet of the discharging circuit. The method includes controlling the isolation valve 44 to a closed position as shown in step 116. This is followed by effecting a demand through the discharging circuit as shown in step 110, e.g., by opening a valve connected to a downstream location of the water outlet 20, e.g., at a faucet. Then the existence of a flow through the isolation valve 44 is determined as shown in step 112, e.g., by detecting whether a flow exists at the valve connected to a downstream location of the water outlet, e.g., the faucet. If the flow does exist, the isolation valve 44 is said to be dysfunctional as shown in step 114.

Figure 7:
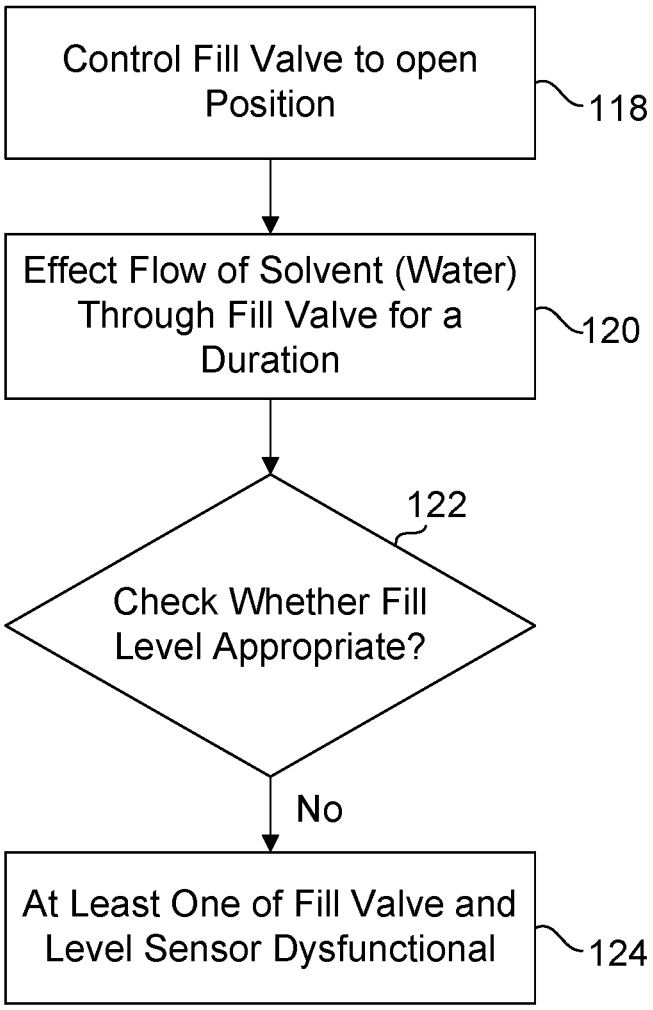
FIG. 7 is a diagram depicting a manner in which a dysfunctional fill valve and/or a level sensor of FIG. 1 is determined.

FIG. 7 is a diagram depicting a manner in which a dysfunctional fill valve 34 and/or a level sensor 36 of FIG. 1 is determined. Disclosed herein is a method useful for determining the proper functioning of a fill valve 34 configured to enable a flow of a solvent into a thermal battery. The fill level of the thermal battery is configured to be determined using a level sensor 36. The method includes controlling the fill valve 34 to an open position as shown in step 118. This is followed by effecting a flow of the solvent through the fill valve 34 for a duration, e.g., about 1 hour, as shown in step 120. In one example, the thermal battery includes a capacity of about 60 gallons. A successful fill of the thermal battery triggers the cancellation of this method. A fill level of the thermal battery is then determined as shown in step 122. One or more readings of the level sensor 36 are taken and compared to a threshold level indicating that the contents of thermal battery are disposed at an appropriate level, e.g., a distance of a few inches below the level sensor 36. If the thermal battery is determined by the level sensor to not have been filled, at least one of the fill valve 34 and the level sensor 36 is determined to be dysfunctional as shown in step 124. In other words, if after about an hour since the thermal battery starts to get filled and the level sensor 36 has not detected the fill level having achieved a level indicating an appropriate level, at least one of the fill valve 34 and the level sensor 36 is determined to be faulty.

Figure 8:
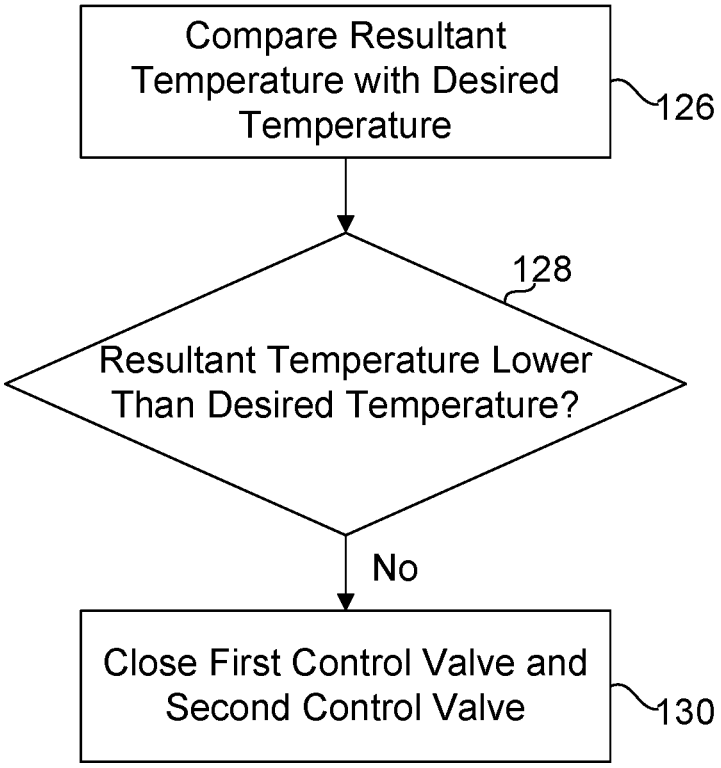
FIG. 8 is a diagram depicting a manner in which the lack of an ability to provide heated water supply is detected and acted upon to reduce wastes due to insufficiently heated water that is discarded.

FIG. 8 is a diagram depicting a manner in which the lack of an ability to provide heated water supply is detected and acted upon to reduce thermal wastes due to insufficiently heated water that is discarded. As there is insufficient thermal reserve stored in the thermal battery and that the charging rate of the thermal battery cannot keep up with the discharging rate, continuing to allow a demand to discharge the thermal battery can only lead to thermal energy continuing to be drawn from the thermal battery while the heated flow will not achieve the set point temperature. Disclosed herein is a method useful for controlling the discharging of a thermal battery including a container 10 for holding a heat storage medium 16 and a coil 12 including an inlet 22 and an outlet 24. The coil is configured for causing an inlet flow received at the inlet 22 to be an outlet flow 24 disposed at a resultant temperature at the outlet, a first control valve 42 interposed at the inlet 22 for controlling the inlet flow into the coil 12, a second control valve 40 interposed at the outlet for controlling a bypass flow of the inlet flow that merges with the outlet flow. Resultant temperature readings are provided by temperature sensor 89. The method includes comparing the resultant temperature to a desired temperature as shown in step 126. If the resultant temperature is determined to be lower than the desired temperature as shown in step 128, the first control valve 42 is controlled to the closed position as shown in step 130 such that thermal discharging can be momentarily terminated when there is not a real possibility that hot water at a set point temperature, e.g., 110 degrees F., can be realistically delivered. The second control valve 40 is left open to allow a demand to continue to draw water through the bypass conductor 38 to indicate that a demand exists when there actually is a demand.

Figure 9:
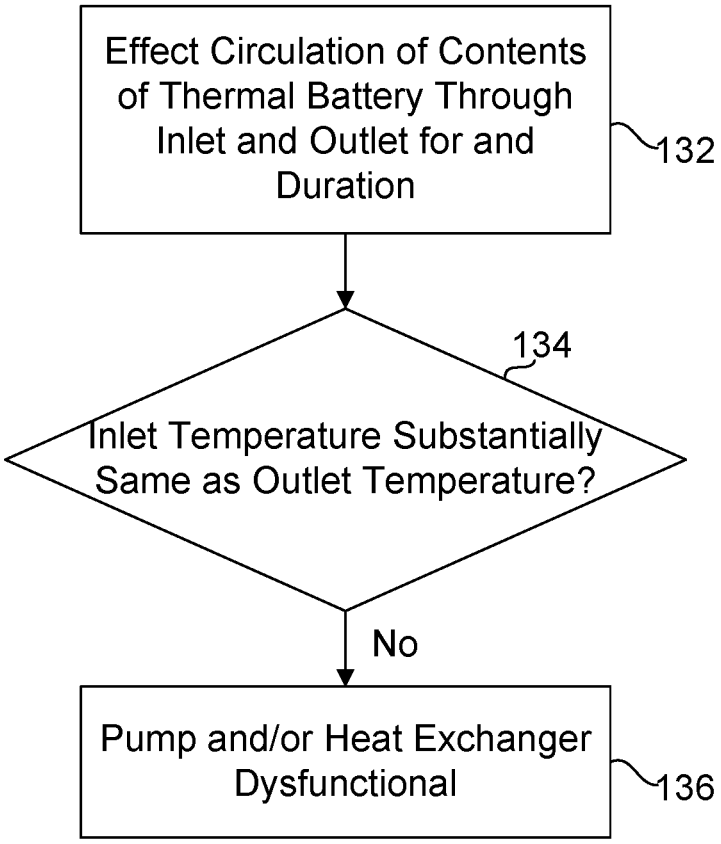
FIG. 9 is a diagram depicting a manner in which a dysfunctional heat source to the thermal battery of FIG. 1 is determined.

FIG. 9 is a diagram depicting a manner in which a dysfunctional heat source to the thermal battery of FIG. 1 is determined. Disclosed herein is a method useful for determining the proper functioning of a heat source of a thermal battery including a heat storage medium 16. The heat source includes a pump 30 and a heat exchanger 70 interposed in a circulation or heat supply loop 32, e.g., the charging circuit, of the thermal battery. The method includes effecting a circulation of the heat storage medium 16 through the circulation loop by turning on the pump 30 for a duration, e.g., about 20-30 seconds, as shown in step 132. This is followed by determining a first temperature of the heat storage medium at an inlet of the circulation loop and a second temperature (as reported by temperature sensor 86) of the heat storage medium 16 at an outlet of the circulation loop as shown in step 134. Temperature sensor 87 is preferably disposed in the vicinity where the charging circuit receives the contents 16 of the container 10, i.e., at the inlet of the heat supply loop 32. If the first temperature is determined to be substantially the same as or within about 2 degrees F. of the second temperature, at least one of the pump 30 and heat exchanger 70 is said to be dysfunctional as shown in step 136.

Figure 10:
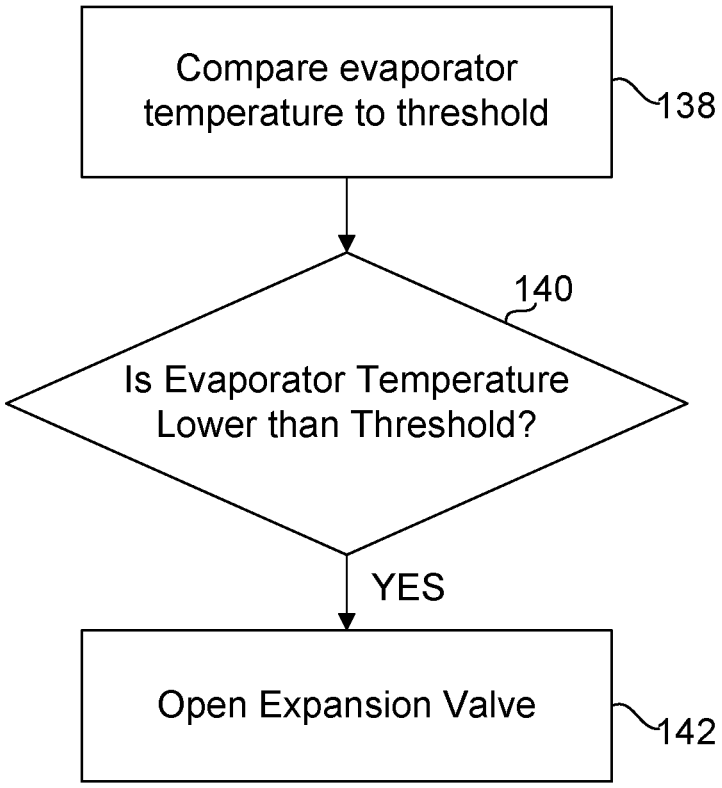
FIG. 10 is a diagram depicting a manner in which risks associated with inadvertent freezing of an evaporator of a heat pump system can be mitigated.

FIG. 10 is a diagram depicting a manner in which risks associated with inadvertent freezing of an evaporator 52 of a heat pump system can be mitigated. Referring back to FIG. 1, the heat pump system includes an evaporator 52 fluidly connected to an expansion valve 56 disposed upstream of the evaporator 52 of a refrigerant flow. A temperature sensor 90 is configured to sense a temperature of the evaporator 52. If ice builds up on the coils of the evaporator 52, it restricts the flow of air through the evaporator 52. This results in reduced airflow around the evaporator 52, leading to a decreased absorption of heat released from fluid conductor 50. The method includes comparing the temperature of the evaporator 52 as provided by temperature sensor 90 to a threshold as shown in step 138. If the temperature of the evaporator 52 is determined to be too low as shown in step 140, i.e., the temperature of the evaporator 52 is lower than the threshold, the expansion valve 56 is opened further as shown in step 142 to cause the refrigerant flow therein to receive additional heat to mitigate risks associated with inadvertent freezing of the evaporator 52. In one embodiment, the threshold is about 35 degrees F.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A method for determining a false reporting of a suitable liquid level detection in a system comprising a container configured to hold a liquid to a first liquid level in the container, a heater disposed within the container, the heater configured to heat at least a portion of the liquid, a temperature sensor disposed at about 3-12 inches above the heater within the container, the temperature sensor configured to sense the temperature of its surroundings in a space within the container and the temperature sensor configured to be disposed within thermal communication of the heater through at least one of the space and the liquid, said method comprising:

(a) effecting the heater for a duration;

(b) determining the rate at which the temperature rises; and (c) comparing the temperature rise rate to a liquid temperature rise rate threshold, wherein if the temperature rise rate is greater than said liquid temperature rise rate threshold, the temperature sensor is determined to not have been submerged in the liquid and the false reporting of a suitable liquid level detection in the system is deemed to have occurred.

2. The method of claim 1, wherein said duration is more than about 10 seconds.

3. The method of claim 1, wherein said liquid temperature rise rate threshold is about 10 degrees F./minute.

4. The method of claim 1, wherein the heater is a resistive heater.

* * * * *